United States Patent [19]

Deutsch

[11] 4,351,218

[45] Sep. 28, 1982

[54] RECURSIVE FORMANT GENERATOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 250,474

[22] Filed: Apr. 2, 1981

[51] Int. Cl.[3] ..... G10H 1/08; G10H 7/00

[52] U.S. Cl. ..... 84/1.19; 84/1.22; 84/DIG. 10

[58] Field of Search ..... 84/1.11–1.13, 84/1.19–1.24, DIG. 9, DIG. 10, DIG. 26

[56] References Cited

U.S. PATENT DOCUMENTS

| | | | |
|---|---|---|---|
| 3,913,442 | 10/1975 | Deutsch | 84/1.19 |
| 3,956,960 | 5/1976 | Deutsch | 84/1.19 |
| 4,084,472 | 4/1978 | Niimi | 84/1.19 X |
| 4,114,498 | 9/1978 | Chibana et al. | 84/1.19 |
| 4,130,043 | 12/1978 | Niimi | 84/1.19 X |
| 4,175,464 | 11/1979 | Deutsch | 84/1.24 |
| 4,192,210 | 3/1980 | Deutsch | 84/1.19 X |
| 4,211,138 | 7/1980 | Deutsch | 84/1.19 X |
| 4,267,761 | 5/1981 | Deutsch | 84/1.19 X |
| 4,281,574 | 8/1981 | Deutsch | 84/1.19 |

*Primary Examiner*—Stanley J. Witkowski
*Attorney, Agent, or Firm*—Ralph Deutsch

[57] ABSTRACT

A sliding formant effect is produced in a tone generator of the type in which wave shape data points are sequentially and repetitively read out of a memory at a rate corresponding to the fundamental pitch of a musical tone. The formant effect is obtained by forming the sums or differences between consecutive data points for one waveshape period and storing the new data in memory in response to a formant control signal. Provision is made for advancing or retarding the effective formant cut-off frequency under command of the formant control signal.

10 Claims, 6 Drawing Figures

RECURSIVE FORMANT GENERATOR FOR AN ELECTRONIC MUSICAL INSTRUMENT

BACKGROUND OF THE INVENTION

1. Field of the Invention

This invention relates to electronic musical tone synthesis and in particular is concerned with a means for producing sliding formants.

2. Description of the Prior Art

One of the essential subsystems contained in an electronic musical instrument of the generic type called a synthesizer, is a sliding formant generator. The sliding formant subsystem is usually implemented as a frequency filter system of either the low pass or high pass type configured so that it has the capability of varying the filter cut-off frequency in response to an electrical control signal.

The most commonly employed sliding formant generator used with analog musical tone generators is that of a voltage controlled frequency filter. This filter is used to vary the analog musical waveshape spectral response under the action of control signal. Digital tone generators can obtain the corresponding spectral variations by employing digital filters to vary the spectral content of a digital sequence of waveshape points which are later converted to analog signals to furnish the musical waveshape. A digital filter implementation for use as a formant filter subsystem is described in the copending patent application Ser. No. 839,916 filed Oct. 6, 1977, now U.S. Pat. No. 4,267,761, and entitled "Musical Tone Generator Utilizing Digital Sliding Formant Filter." This invention and the present invention have a common assignee.

As a general rule digital filters are not low cost systems because they are usually configured from basic elements having the functions of data delay, multipliers, coefficient memories, and adders. The multiplier is the most undesirable element because such digital operations are relatively expensive in comparison to the other digital logic operations comprising a digital filter.

The conventional variety of digital filters for use as sliding formant generators has been circumvented in digital tone generators of the type in which the musical waveshape is computed using a discrete Fourier transform algorithm employing preselected sets of harmonic coefficients. The selected harmonic coefficients are readily scaled in a time variant manner such that the resultant computed musical waveshape exhibits a spectral effect similar to that obtained by the sliding formant filters. Such systems have been described in U.S. Pat. No. 3,809,786 entitled "Computor Organ" and in U.S. Pat. No. 4,085,644 entitled "Polyphonic Tone Synthesizer."

In U.S. Pat. No. 4,130,043 entitled "Electronic Musical Instrument Having Filter-And-Delay Loop For Tone Production" a type of sliding formant filter is described which uses a single fixed filter employed in a signal feedback configuration. The musical waveshape source is a digital memory containing equally spaced points for one period of the corresponding musical waveshape. This data is sequentially and repetitively read out of the memory at the preselected clock rates and converted to an analog waveshape. In response to a command signal, the output data from the memory for a single period is passed through a low pass digital filter and used to replace the data in the memory. It was claimed that this process would produce the effect of a sliding low pass filter whose cut-off frequency varies with the number of times that data from the memory has been processed by the filter. No provision is made for sliding the formant in both an increasing and decreasing cut-off frequency excursion.

SUMMARY OF THE INVENTION

The present invention is directed to apparatus for producing a sliding formant effect obtained by using a feedback data arrangement in a digital tone generator.

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data set is generated by implementing a discrete Fourier transform algorithm using stored sets of harmonic coefficients which characterize preselected musical tones. The computations are carried out at a fast rate which may be nonsynchronous with any musical frequency. Preferably the harmonic coefficients and the orthogonal functions required by the Fourier transform algorithm are stored in digital form and the computations are carried out digitally. At the end of a computation cycle the master data set resides in a memory.

Following a computation cycle, a transfer cycle is initiated during which the master data set data are transferred to preselected members of a multiplicity of tone generators. The output tone generation continues uninterrupted during the computation and transfer cycles.

The master data set stored in each of the preselected members of the multiplicity of tone generators is sequentially and repetitively read out of storage and converted to an analog musical waveshape by means of a digital-to-analog converter. The memory addressing rate is proportional to the corresponding fundamental of the musical pitch associated with a tone generator. In response to a formant control signal, the data points addressed out from the tone generator's memory are processed to form successive amplitude sums. The sums are stored in the memory to replace the original master data set. This process of computing successive sums is repeated each time the formant control signal calls for an advance. The advance signals are used to increment an up/down counter whose contents indicate the number of times the master data set has been modified by computing successive amplitude sums. The formant control can also have a down state which decrements the up/down counter. Each time the up/down counter changes its count state, the process of computing successive sums and storing the result is repeated for the set of waveshape data points for a number of times equal to the count state of the up/down counter. The result is a formant generating system whose cut-off frequency can be changed in both higher and lower frequency direction in response to a control signal.

It is an object of this invention to provide a sliding formant generating system in a digital tone generator in which the cut-off frequency can be changed in either an increasing or decreasing frequency direction in response to a control signal.

It is a further object of this invention to provide a means for generating a controllable sliding formant in a digital tone generator which does not require a digital multiplier.

BRIEF DESCRIPTION OF THE DRAWINGS

For a better understanding of the invention reference should be made to the accompanying drawings.

DETAILED DESCRIPTION OF THE INVENTION

The present invention is directed to a sliding formant generating subsystem incorporated in a musical tone generator of the type that repetitively reads successive waveshape sample points from a memory at a rate corresponding to an actuated switch on the musical instrument's array of keyboard switches. The sample points accessed from the memory are converted to analog musical signals by means of a digital-to-analog converter. A tone generation system of this type is described in detail in U.S. Pat. No. 4,085,644 entitled "Polyphonic Tone Synthesizer" which is hereby incorporated by reference. In the following description all elements of the system which are described in the referenced patent are identified by two digit numbers which correspond to the same numbered elements appearing in the patent. All system element blocks which are identified by three digit numbers correspond to elements added to the Polyphonic Tone Synthesizer to implement the improvements of the present invention to produce the tonal effect of a sliding formant.

As described in detail in the above-identified patent, if the master data set is computed with odd symmetry the sample points comprising the master data set are expressed by the relation $$x_n = \sum_{q=1}^{M/2} c_q \sin(2\pi nq/m);\ n = 1,2,\ldots,M \qquad \text{Eq. 1}$$

where M is the total number of points $x_n$ in one period of the corresponding musical wave shape and $c_q$ is the harmonic coefficient for the harmonic number q.

The spectral components, or harmonic coefficients, can be expressed as follows as a Fourier transform of Eq. 1

$$c_q = \sum_{n=1}^{M} x_n \sin(2\pi nq/M) \qquad \text{Eq. 2}$$

After a delay of one data point, the successive sum can be formed as $$y_n = (x_{n+1} + x_n)/2 \qquad \text{Eq. 3}$$

The spectral components $b_q$ of the successive sums can be obtained from the Fourier transform of $y_n$, or $$b_q = \sum_{n=1}^{M} y_n \sin(2\pi nq/M) \qquad \text{Eq. 4}$$

-continued $$= 0.5 \sum_{n=1}^{M} x_n \sin(2\pi nq/M)$$

$$+ 0.5 \sum_{n=1}^{M} x_{n+1} \sin(2\pi nq/M)$$

$$= c_q/2 + 0.5 \sum_{n=1}^{M} x_{n+1} \sin(2\pi nq/M)$$

The change of variable u=n+1 is made in the last sum term of Eq. 4. Using the property that $x_u$ is periodic with odd symmetry yields the spectral component expression for successive amplitude sums:

$$b_q = c_q[1 + \cos(2\pi q/M]/2 \qquad \text{Eq. 5}$$

$$= c_q \cos^2(\pi q/M).$$

The trigonometic term will be equal to ½ when the harmonic number q=M/4. Thus the −3 db attenuation point for the filter effect produced by evaluating successive sums will occur at the harmonic number q equal to one-half of the total number of possible harmonics determined by the number M of evenly spaced data points for each period of the waveshape. The number of possible harmonics for a waveshape represented by M equally spaced points is M/2.

Figure 1:
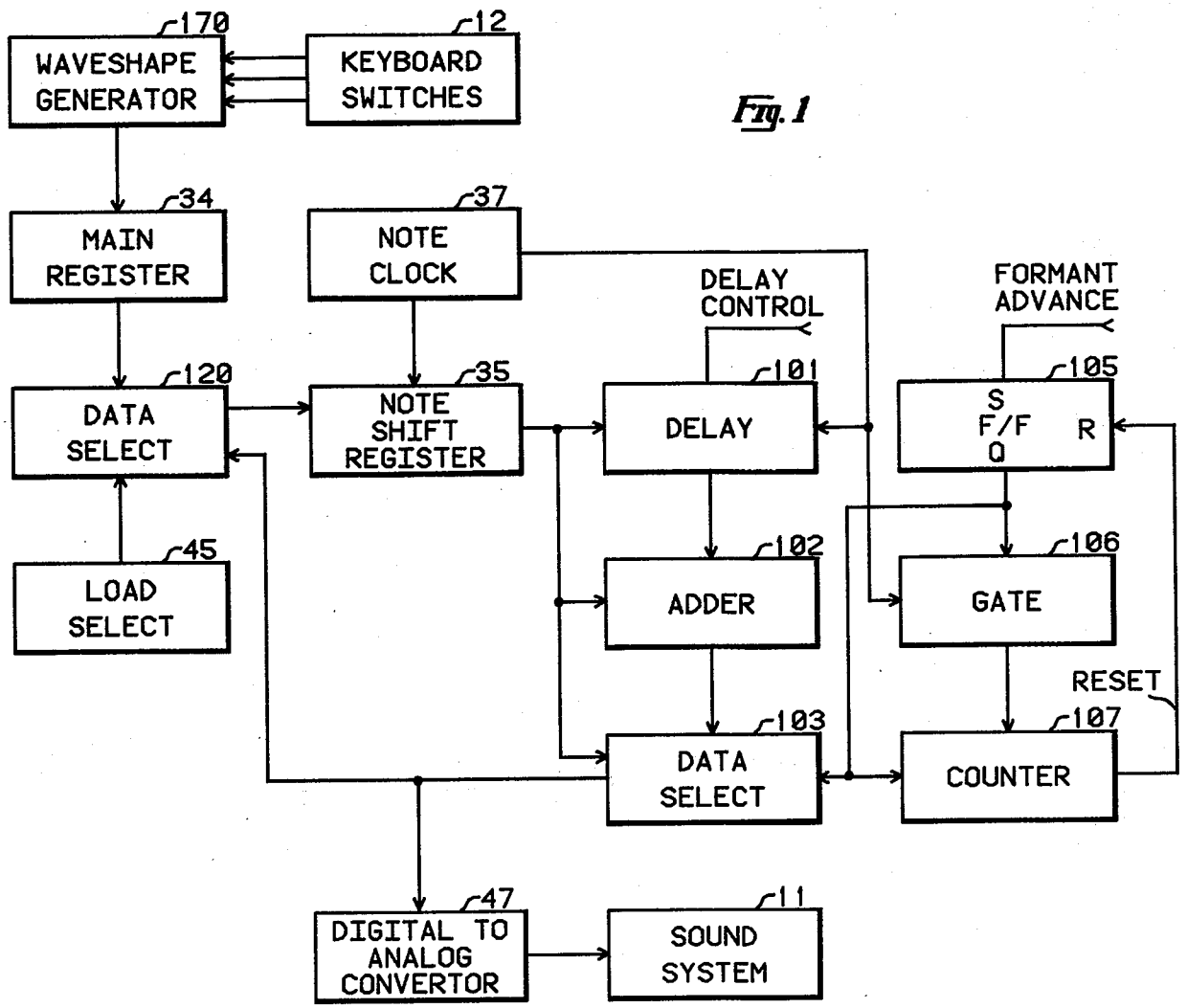
FIG. 1 is a block diagram of a low pass sliding formant system.

FIG. 1 illustrates a sliding formant system for creating the tonal effect of a sliding low pass filter.

In response to closures of switches in the keyboard switches 12, a master data set of points corresponding to equally spaced points for one period of a musical waveshape are generated by means of the waveshape generator 170 as described in the above referenced patent (U.S. Pat. No. 4,085,644). The master data set is stored in the main register 34. The master data set is transferred to a plurality of tone generators assigned to the actuated switches in the keyboard switches 12. Only one of these tone generators is shown explicitly in FIG. 1.

During the transfer cycle load select 45 will generate a signal indicating when the master data set residing in the main register 34 is to be read out and stored in the note shift register 35. In response to the signal from the load select 45, data select 120 will transfer the master data set data read from the main register 34 to the note shift register 35.

Data is read out of the note shift register 35 in the usual end-around fashion under control of timing signals provided by the note clock 37. There are a variety of methods for implementing a voltage controlled oscillator which can be used for the note clock 37. One such implementation is described in detail in U.S. Pat. No. 4,067,254 which is hereby incorporated by reference.

If the flip-flop 105 has not been set, its output logic state is Q="0". In response to the state Q="0", data select 103 selects the data read out of the note shift register and sends this data on to the data select 120 so that the note shift register 35 operates in an end-around read-write mode in which output data is rewritten as input data to the shift register. The digital data selected for transfer by the data select 103 is converted to an analog musical waveshape by means of the digital-to-analog converter 47 and provided to the sound system 11.

The sliding formant tonal effect is actuated when a formant advancee signal is generated. The formant advance signal can be generated by means of a timing clock which is started each time that the keyswitch assigned to the tone generator is actuated.

The flip-flop 105 is set in response to a formant advance signal thereby creating an output logic state Q="1". In response to the logic state Q="1", gate 106 transfers timing signals from the note clock 37 which are used to increment the counter 107. Moreover in response to the logic state Q="1", data select 103 selects and transfers to the data select 120 the input data received from the adder 102.

One input to the adder 102 is the current data point value addressed out from the note shift register 35. The second input to the adder 102 is the previous data point which is obtained by the one note clock delay in the delay 101.

Counter 107 is implemented to count modulo the number of data points stored in the note shift register 35. When counter 107 is incremented so that it returns to its minimal count state a RESET signal is generated. The RESET signal is used to reset the flip-flop 105 so that its output logic state becomes Q="0". At this time a complete new set of waveshape points has been computed by adding successive differences for one complete waveshape period.

The output data from the adder 102 is shifted to the right by one binary bit to affect a division by two of the data points transferred to the data select 103.

During the time required to compute the new waveshape points the data transferred by the data select 103 is continuously converted to a musical signal so that the tone generation is not interrupted by the process of computing a new set of waveshape points. Until a new formant advance signal is received, the tone generation proceeds with the presently available set of waveshape data points residing in the note shift register.

Figure 2:
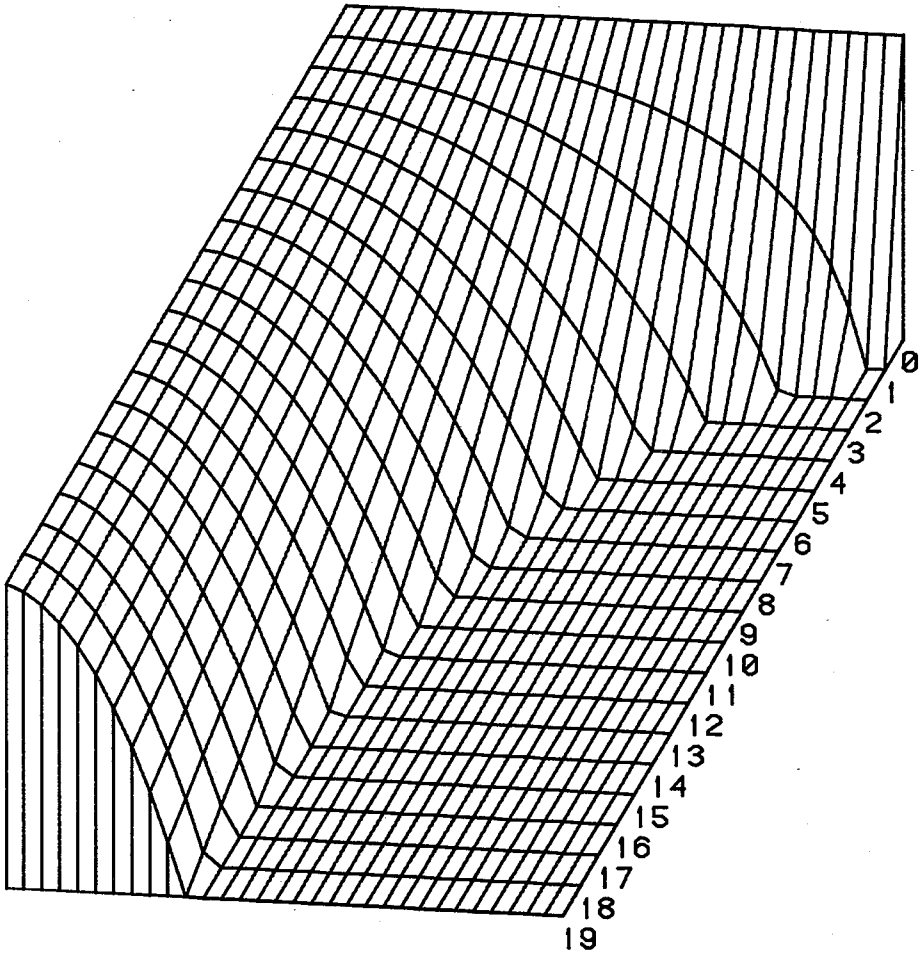
FIG. 2 is a graph illustrating the spectral changes for a low pass sliding formant filter.

FIG. 2 illustrates the output spectrum for a musical tone generated by the sliding formant system shown in FIG. 1. The original master data set was generated by using 31 harmonics of equal strength and the 32nd harmonic at a relative level of 60 db less than the other harmonic coefficients. The original output spectrum has the label 0 (zero) at the right edge. Each label indicates the output spectrum for each successive formant advance signal. The height of the spectral lines corresponds to a normalized value of 0 db while the lower level, or "ground plane", corresponds to a value of −50 db. The vertical lines are plotted for each harmonic with the fundamental at the left. The effect of a sliding low pass formant filter is clearly indicated in FIG. 2.

Figure 3:
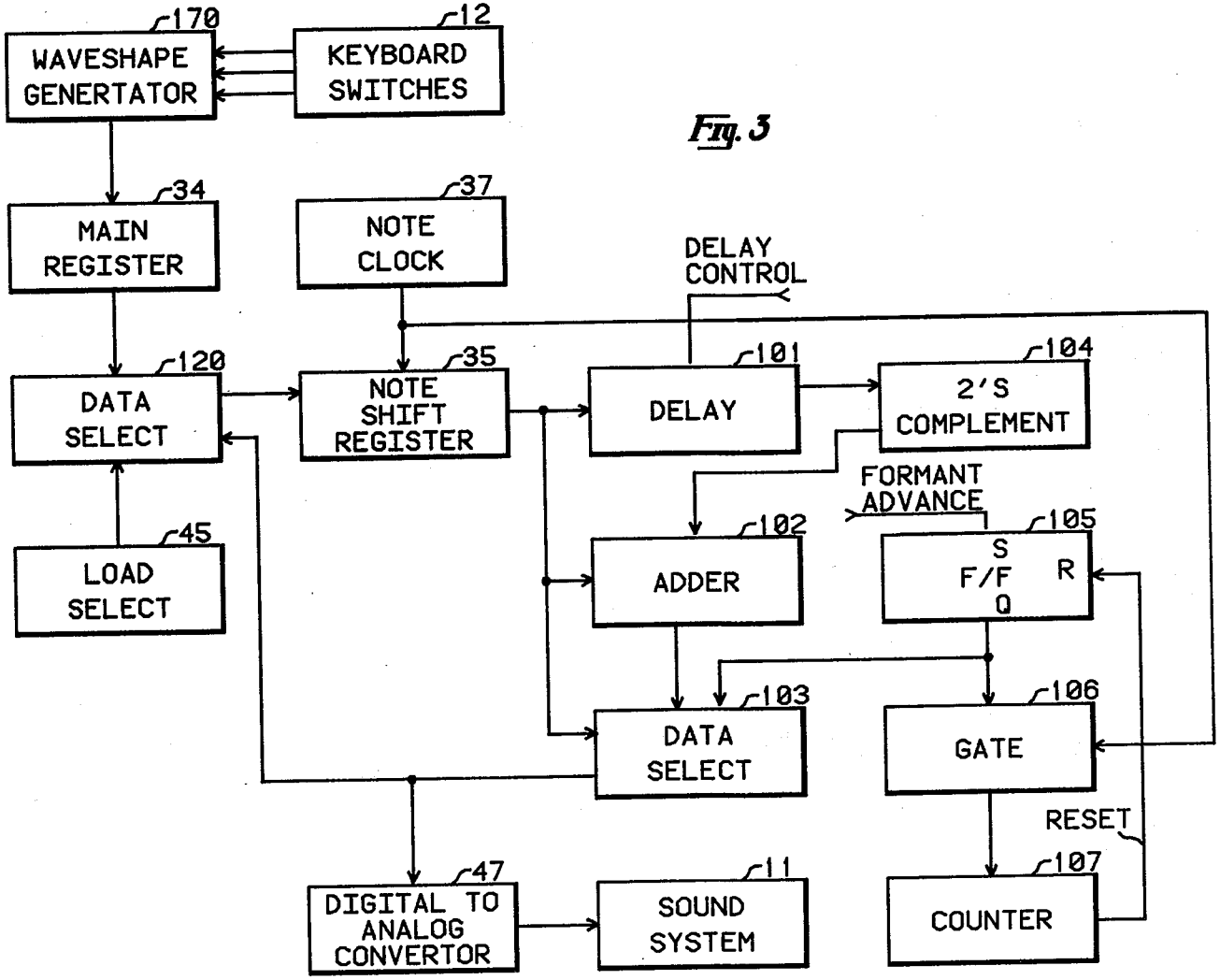
FIG. 3 is a block diagram of a high pass sliding formant filter.

The tonal effect of a sliding high pass filter can be obtained a modification of the system shown in FIG. 1. This modification is shown in FIG. 3. The modification consists of transforming the data output from the delay 101 to the corresponding 2's complement form by means of the 2's complement 104. The 2's complement operation is equivalent to forming the negative value of the input data. In this fashion the adder 102 furnishes the values of the differences of successive amplitude points read out of the note shift register to one of the input data terminals of the data select 103. The successive amplitude differences are $$y_n=(x_{n+1}-x_n)/2 \qquad \text{Eq. 6}$$

The corresponding new spectral conponents, or harmonic coefficients are $$\begin{aligned} b_q &= c_q(1-\cos 2\pi q/m)/2 \\ &= c_q \sin^2 \pi q/M \end{aligned} \qquad \text{Eq. 7}$$

In this case the new spectral components are related to the old components, for each complete waveshape data calculation, by a trigonometric sine-squared function. Thus the modified spectrum is attenuated more at the higher frequencies than at the lower frequencies.

Figure 4:
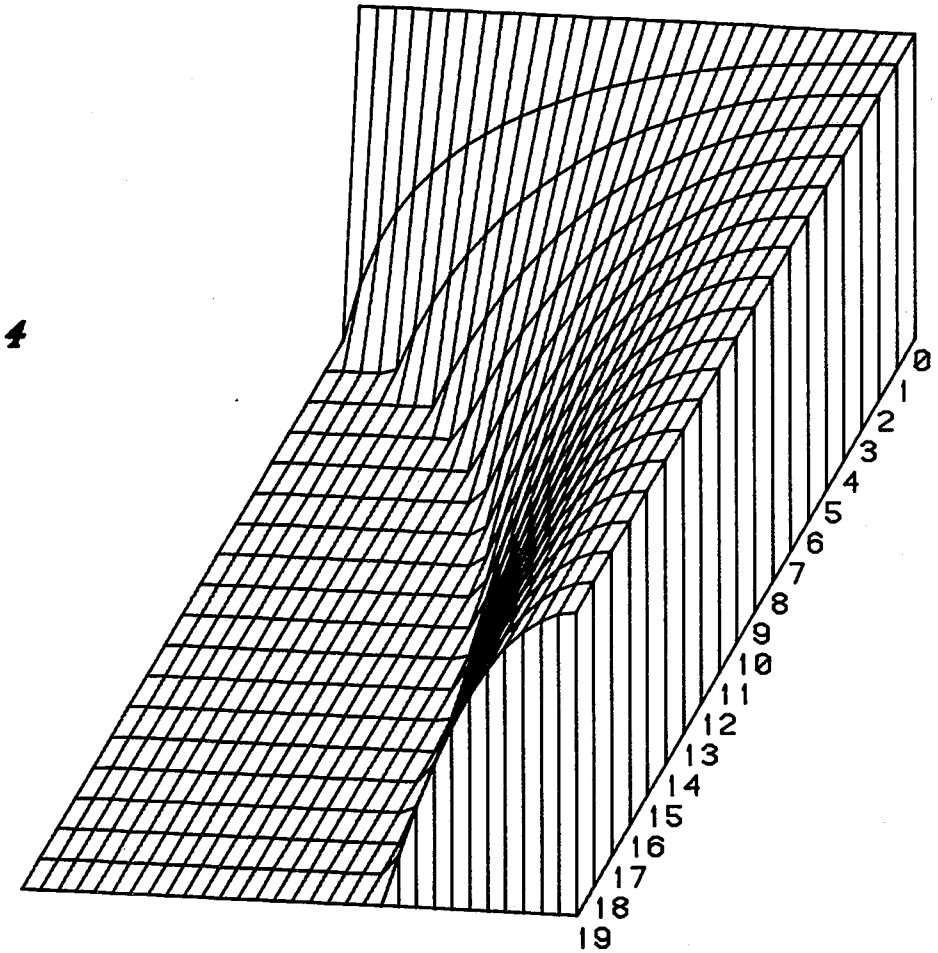
FIG. 4 is a graph illustrating the spectral changes for a high pass sliding formant filter.

FIG. 4 illustrates the output spectrum for a musical tone generated by the sliding formant system shown in FIG. 3. The original master data is the same as that used to generate the family of curves shown in FIG. 2 and previously described. The original output spectrum is identified by the 0 label at the right side. Each label indicates the output spectrum for each successive formant advance signal. The effect of a sliding high pass formant filter is clearly indicated in FIG. 4. A variety of sliding formant effects can be obtained by implementing the delay 101 in FIG. 1 or FIG. 3 to provide more than one clock delay. The number of clock delays can be selected by means of a delay control signal.

Figure 5:
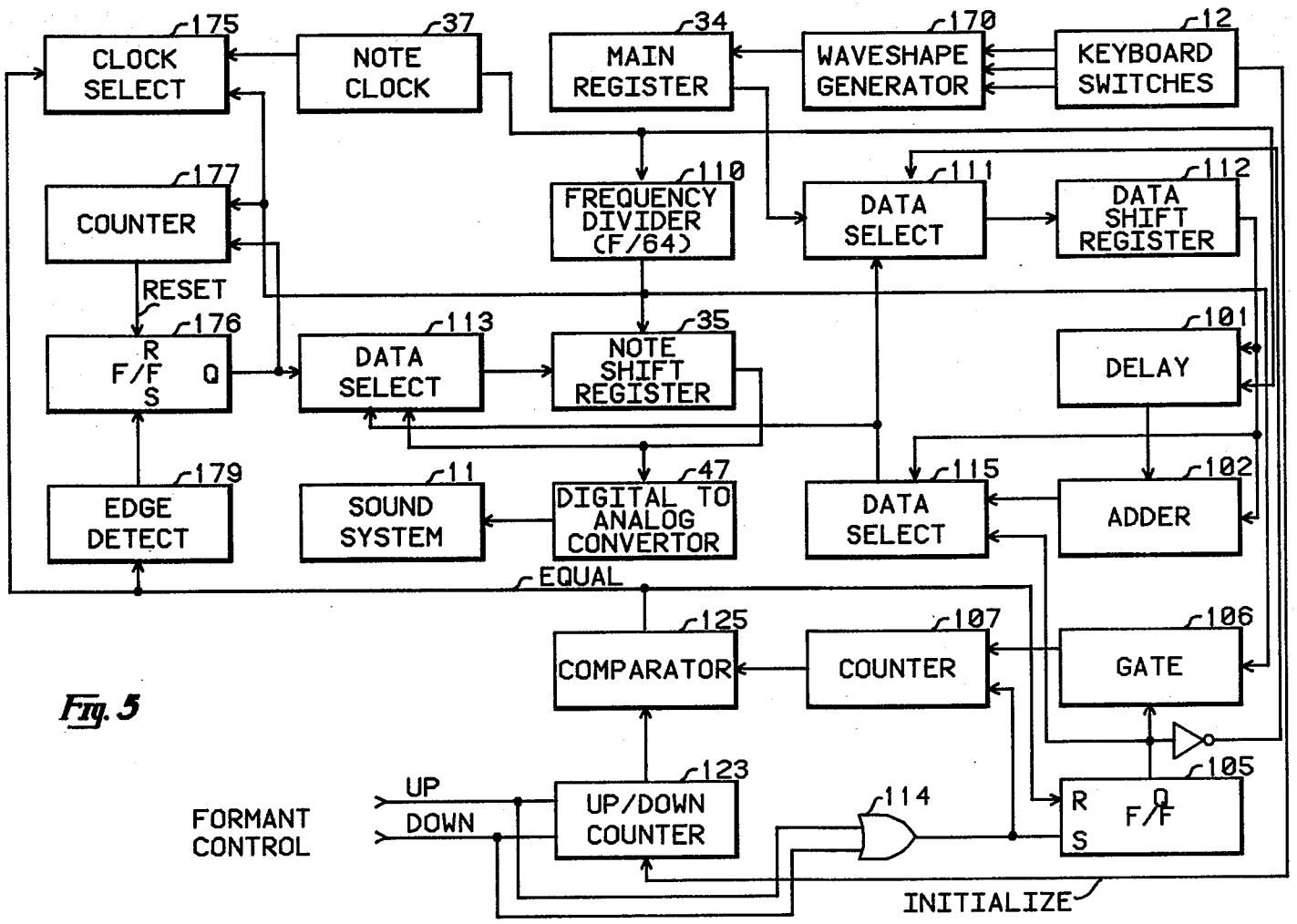
FIG. 5 is a block diagram of a bidirectional low pass sliding formant system.

Both the systems shown in FIGS. 1 and 3 produce a monotonic sliding formant effect in that each formant advance signal causes the formant to always change in a single direction. In many musical tone synthesizers it is desirable to move the sliding formant effect in either an increasing frequency direction (or mode) or a decreasing frequency direction (or mode) in response to a control signal such as that produced by an ADSR (attack/decay/sustain/release) envelope generator. FIG. 5 illustrates a system that produces a bidirectional sliding formant tonal effect. In this system, when a change of the sliding formant control is detected, a new waveshape is quickly generated from a memory containing the original master data set and the new waveshape data points are stored in the note shift register 35. In this fashion the sliding formant can be generated in either an increasing or a decreasing mode.

The system speed requirements are readily computed. Suppose that the master data set has M=64 points for one complete period of the corresponding musical waveshape. This corresponds to a tone having the capability of having M/2=32 harmonics. The highest musical pitch on an organ keyboard is $C_7$ which corresponds to a fundamental frequency of 2093 hz. Therefore the highest frequency $f_m$ at which successive data points must be accessed from the note shift register is $$f_m=64\times 2093=133.95 \text{ khz.}$$

If the calculations for each modified waveshape are accomplished with a logic clock rate of $f_c=2.68$ mhz, then 20 complete waveshape modifications can be completed in the time interval during which successive data points are read out of the note shift register 35. This time requirement is sufficient for any musical note having a frequency not greater than that of $C_7$. The frequency $f_c$ is well within the speed capability of microelectronic circuitry.

In the system shown in FIG. 5, the note clock 37 is set a frequency of 64×64=4096 times the fundamental frequency of the associated generated musical tone. The timing signals generated by the note clock 37 are divided by 64 by means of the frequency divider 110. The resultant divided frequency signals are used to advance and access data from the note shift register 35.

The formant cut off harmonic position is controlled by incrementing or decrementing the count states of the up/down counter 123. The Formant Control signal is divided into two signal lines. A signal on the UP line will cause the up/down counter 123 to be incremented and a signal on the DOWN line will cause this counter to be decremented. Any change in the count state of the up/down counter will be accompanied by a logic "1" output from the OR-gate 114. The count state of the up/down counter 123 is equal to the number of sequences of successive additions of adjacent data points that have been performed for the 64 data points corresponding to the output musical waveshape.

In response to a logic "1" signal from the OR-gate 114, flip-flop 105 is set so that the output logic state is Q="1". When the flip-flop 105 is set, gate 106 will transmit timing signals from the output of the frequency divider 110 to increment the counter 107.

Counter 107 is reset to its initial value in response to a logic "1" signal at the output of the OR-gate 114. Counter 107 is implemented to count modulo $64 \times 64 = 4096$.

The comparator 115 compares the count state of the up/down counter 123 with the six most significant bits of the count state of counter 107. The six most significant bits of the counter 107 are equal to the number of complete cycles of 64 data points that are read out of the note shift register from the time that the count state of the up/down counter 123 has changed in response to a formant control signal.

When the six most significant bits of the count state of the counter 107 are equal to the state of the up/down counter 123, the comparator 125 generates an EQUAL signal. The EQUAL signal is used to reset the flip-flop 105 and thereby inhibits further clock pulses from the frequency divider 110 from being used to increment the counter 107.

Data that is read out of the note shift register 35 is converted to an analog form musical waveshape by means of the digital-to-analog converter 47 and then provided to the sound system 11.

When the output state of flip-flop 105 is the logic state Q="0", a logic "1" signal is sent to the data select 111. In response to a logic "1" signal, the data select 111 will transfer the master data set residing in the main register 34 to the data shift register 112 during a transfer cycle.

Data shift register 112 is operated in the end-around mode in response to timing signals from the note clock 37. Thus the data is shifted 64 times faster in the data shift register 112 than the data shifted in the note shift register 35. The data read out of the data shift register 112 is written into its input terminal as long as the logic output state of the flip-flop 105 is Q="0". This action is accomplished by the combined actions of data select 115 and data select 111.

When Q="1", the data select 111 will transfer data received from the data select 115 to be written into the data shift register 112.

The data read out of the data shift register 112, in response to the timing signals created by the note clock 37, is delayed by one timing signal period by means of the delay 101. The output delayed data from the delay 101 is added to the next accessed data point from the data shift register by means of the adder 102. The summed data of adjacent data points is divided by two using a right binary shift of one bit position and provided as one of the data signal inputs to the data select 115. The second data signal input to the data select 115 is the data read out of the data shift register 112.

The net result of the preceding operations is that the master data set values transferred from the main register 34 is modified by summing successive data points for a number of waveshape periods equal to the count state of the up/down counter 123. This modified data resides in the data shift register 112.

In response to the EQUAL signal from the comparator 125, clock select 175 selects the output of the frequency divider 110 to provide timing signals for the data shift register 112. If the EQUAL signal is not present, then clock select 175 selects and transfers the timing signals generated by the note clock 37. In response to the EQUAL signal, the current waveshape data points residing in the data shift register 112 are transferred into the note shift register 35 via data select 113.

The EQUAL signal is converted to a pulse by means of the edge detect 177 and the pulse is used to set the flip-flop 176. When the flip-flop 176 is set, data select 113 will transfer data from the output of data select 115 to be written into the note shift register 113. Counter 177 is implemented to count 64 which is the number of data points stored in the note shift register 35. Counter 177 is initialized when the flip-flop 176 is set. Counter 177 is incremented by the output timing signals from the frequency divider 110. When counter 177 reaches its maximum count and is reset because of its modulo counting action, a RESET signal is generated which is used to reset the flip-flop. In this fashion only the necessary 64 waveshape data points are transferred and stored in the note shift register 35. When the flip-flop 176 is reset, data select 113 cause the note shift register to operate in an end-around mode.

A sliding high pass operation can be obtained readily in the system shown in FIG. 5. The high pass mode is obtained by interposing a 2's complementer between the output of the delay 101 and the adder 102 in the analogous manner shown explicitly in FIG. 3 for the 2's complement 104.

Figure 6:
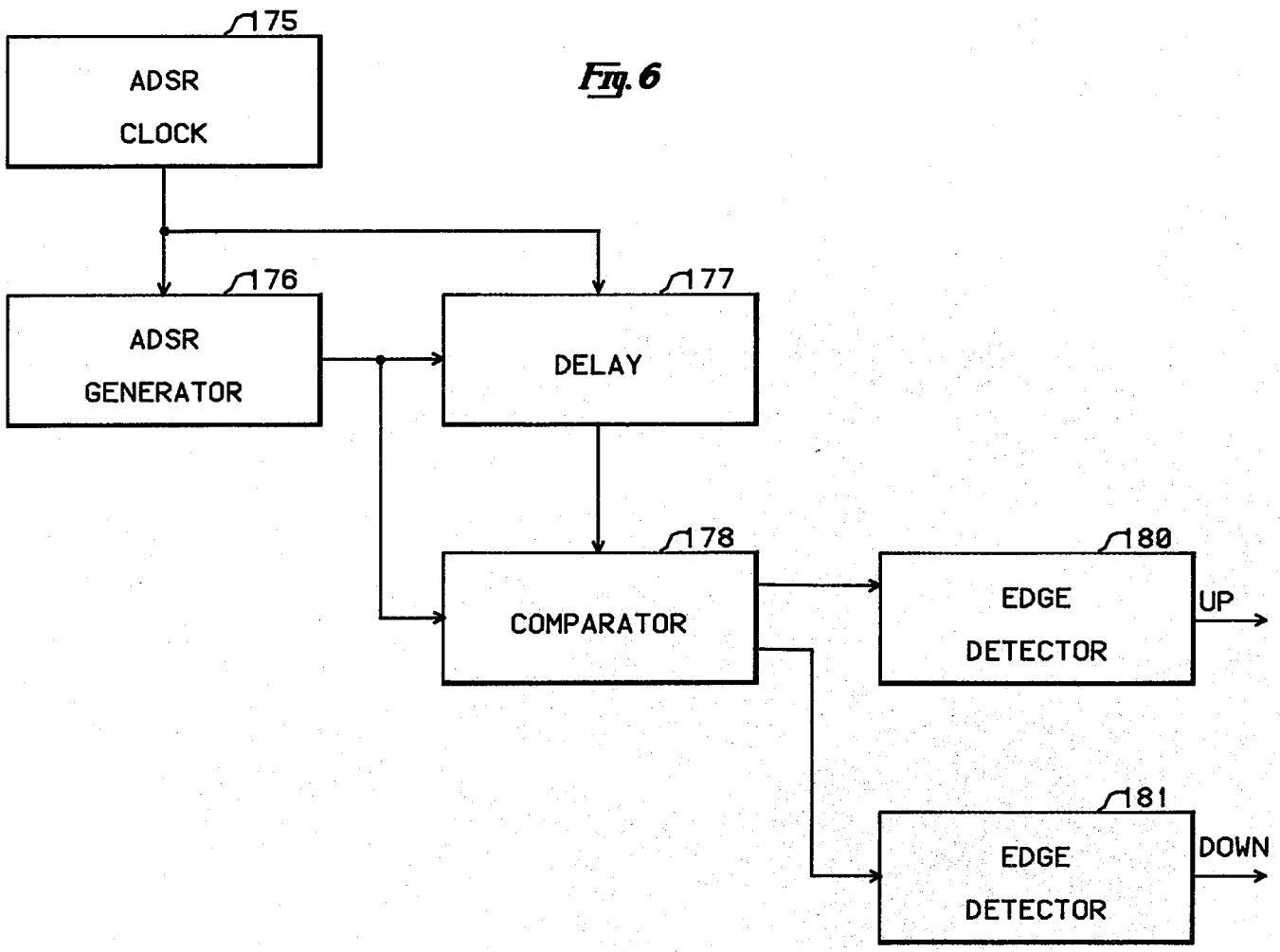
FIG. 6 is a block diagram of a formant control signal generator.

The Formant Control signal can be generated in any convenient manner. FIG. 6 illustrates a subsystem for generating the up/down components of a Formant Control signal using a conventional ADSR envelope generator as the control signal source. A suitable ADSR generator is described in detail in U.S. Pat. No. 4,079,650 which is hereby incorporated by reference. The output digital data values from the ADSR generator 176 occur at a rate determined by the ADSR clock 175.

The ADSR amplitude points are delayed by one ADSR clock period by means of the delay 177. The present and previous amplitude points are compared in the comparator 178. If no change has occurred, no signal is transmitted from the comparator 178. If the present data point is found to be greater in magnitude than the previous data point, a signal is sent to the edge detect 179 which generates an UP-Formant Control signal. If the present data point is found to be less in magnitude than the previous data point, a signal is sent to the edge detect 180 which generates a DOWN-Formant Control signal.

An important characteristic of the formant generation system described above is that the formant spectral changes are varied in the described digital manner without any transient effects that are typical of conventional time domain digital filters. That is, at the end of the full 64 points for a waveshape period the output of the formant generation subsystem is the true steady state condition.

I claim:

1. In combination with a musical instrument having a waveshape memory storing a plurality of waveshape data points corresponding to the amplitudes of a corresponding number of evenly spaced points defining a period of a musical signal and in which said data points are sequentially and repetitively read out of the waveshape memory and transferred to a digital-to-analog converter at a rate corresponding to the pitch of the musical note being generated, apparatus for producing a sliding formant effect comprising;

a note clock for generating timing signals corresponding to the pitch of said generated musical note, addressing means responsive to said timing signals whereby data is sequentially and repetitively read out of said waveshape memory, a delay means for storing data read out of said waveshape memory, an adder means whereby data read out of said waveshape memory is summed with data stored in said delay means to form a summed data set, a formant signal advance generator means for generating a formant advance signal, a first data select means whereby said summed data set is selected in response to said formant advance signal and whereby said data read out of said waveshape memory is selected if said formant advance signal is not generated, a second data select means whereby data selected by said first data select means is stored in said waveshape memory, and conversion means wherein data selected by said first data select means is converted to said musical signal thereby producing said sliding formant effect.

2. Apparatus according to claim 1 wherein said first data select means comprises;

a counter means having count states incremented by said timing signals, reset circuitry means whereby said counter means is reset to an initial count state in response to said formant advance signal, a gating means responsive to the count states of said counter means whereby said formant advance signal is provided to said first data select means for a sequence of said timing signals equal in number to said plurality of waveshape data points stored in said waveshape memory.

3. Apparatus according to claim 1 wherein said delay means comprises;

a delay memory means, addressing circuitry whereby data read out of said waveshape memory is stored in said delay memory means in response to said timing signals, and reading circuitry responsive to said timing signals whereby data stored in said delay memory means is read out and replaced by data read out from said waveshape memory.

4. Apparatus according to claim 1 further comprising;

a complementor means interposed between said delay means and said adder means whereby data read out of said delay means is transformed to its corresponding negative value.

5. In combination with a keyboard musical instrument having an array of keyboard switches and having a waveshape memory storing a plurality of waveshape data points corresponding to the amplitudes of a corresponding number of evenly spaced points defining a period of a musical signal and in which said data points are sequentially and repetitively read out of a waveshape memory and transferred to a digital-to-analog converter at a rate corresponding to the pitch of the musical note of an associated keyboard switch, apparatus for producing a sliding formant effect comprising;

a note detect means whereby a note signal is generated when a switch in said array of keyboard switches changes from an unactuated to an actuated state, a note clock for generating timing signals corresponding to the pitch of a musical note associated with a keyboard switch whose state change causes the generation of said note signal, a formant signal generator means wherein a formant signal is generated, a first memory means for storing data to be thereafter read out, a first data select means whereby in response to said note signal data stored in said waveshape memory is transferred and stored in said first memory means and whereby in response to said formant signal a modified data set is transferred and stored in said first memory means, a first addressing means responsive to said timing signals whereby data is sequentially and repetitively read out of said first memory means, a delay means for storing data read out of said first memory means, an adder means whereby data read out of said first memory means is summed with data stored in said delay means to produce a summed data set, a second data select means whereby said summed data set is selected in response to said formant signal and whereby the data read out of said first memory means is selected if said formant signal is not generated and wherein the selected data comprises said modified data set, a second memory means for storing data to be thereafter read out, a third data select means whereby in response to said formant signal said modified data set is stored in said second memory means, a second addressing means responsive to said timing signals whereby data is sequentially and repetitively read out of said second memory means, and conversion means whereby data read out of said second memory means is converted to said musical signal thereby producing said sliding formant effect.

6. Apparatus according to claim 5 wherein said delay means comprises;

a delay memory means, addressing circuitry whereby data read out of said first memory means is stored in said delay memory means in response to said timing signals, and reading circuitry responsive to said timing signals whereby data previously stored in said delay memory means is read out and replaced by data read out from said first memory means.

7. Apparatus according to claim 5 wherein said formant signal generator means comprises;

a bidirectional signal generator wherein an up-signal is generated if said sliding formant effect is selected in an increasing mode and wherein a down-signal is selected in a decreasing mode, a first counter means wherein its count state is incremented in response to said up-signal and wherein its count state is decremented in response to said down-signal, first initializing circuitry whereby said counter means is initialized to a preselected count state in response to said note signal, a second counter means incremented by said timing signals and wherein the count state is initialized in response to said up-signal and in response to said down-signal, a clock gate interposed between said note clock and said second counter means whereby said timing signals are transferred to said second counter means in response to a gate control signal, control generating means wherein said gate control signal is generated in response to said up-signal and in response to said down-signal and wherein said gate control signal is not generated if a count equal signal is generated, and a comparator means whereby said count equal signal is generated if the count state of said first counter means is equal to the count state of said second counter means.

8. Apparatus according to claim 7 wherein said third data select means comprises;

a third counter means incremented by said timing signals, second initializing circuitry whereby the count state of said third counter means is initialized in response to said count equal signal, and a transfer gating means whereby said modified data set is stored in said second memory means if the count state of said third counter means is less than a preselected count state.

9. Apparatus according to claim 7 wherein said bidirectional signal generator comprises;

a formant clock source for generating formant during signals, a formant sequence generator whereby a sequence of control signals is generated in response to said formant timing signals, and an up-signal generator means wherein said up-signal is generated when the difference between consecutive values of said sequence of control signals is a positive value, wherein said down-signal is generated when the difference between the consecutive values of said sequence of control signals is a negative value, and wherein neither an up-signal nor a down-signal is generated when consecutive values of said sequence of control signals are of equal value.

10. Apparatus according to claim 5 further comprising;

a complementor means interposed between said delay means and said adder means whereby data read out of said delay means is transformed to its corresponding negative value.

* * * * *

UNITED STATES PATENT AND TRADEMARK OFFICE

CERTIFICATE OF CORRECTION

PATENT NO. : 4,351,218

DATED : September 28, 1982

INVENTOR(S) : Ralph Deutsch

It is certified that error appears in the above-identified patent and that said Letters Patent are hereby corrected as shown below:

Column 12, line 10 change "during" to --timing--.

Signed and Sealed this

Third Day of May 1983

[SEAL]

*Attest:*

GERALD J. MOSSINGHOFF

*Attesting Officer*

*Commissioner of Patents and Trademarks*